US009121592B2

(12) United States Patent
Chen

(10) Patent No.: US 9,121,592 B2
(45) Date of Patent: Sep. 1, 2015

(54) ELECTRICAL CONNECTOR

(71) Applicant: Chia-Yung Chen, Taipei (TW)

(72) Inventor: Chia-Yung Chen, Taipei (TW)

( * ) Notice: Subject to any disclaimer, the term of this patent is extended or adjusted under 35 U.S.C. 154(b) by 354 days.

(21) Appl. No.: 13/886,292

(22) Filed: May 3, 2013

(65) Prior Publication Data

US 2014/0329412 A1 Nov. 6, 2014

(51) Int. Cl.
*H01R 13/66* (2006.01)
*F21V 23/06* (2006.01)

(52) U.S. Cl.
CPC ..... *F21V 23/06* (2013.01); *H01R 13/66* (2013.01)

(58) Field of Classification Search
CPC ..... H01R 13/502; H01R 13/6658; H01R 13/6581; H01R 4/242
USPC ..... 439/620.22
See application file for complete search history.

(56) References Cited

U.S. PATENT DOCUMENTS

| | | | | |
|---|---|---|---|---|
| 7,326,086 | B1 * | 2/2008 | Lee | 439/630 |
| 8,777,666 | B2 * | 7/2014 | Golko et al. | 439/607.34 |
| 2012/0052731 | A1 * | 3/2012 | Hsiao et al. | 439/620.22 |

* cited by examiner

*Primary Examiner* — Jean F Duverne
(74) *Attorney, Agent, or Firm* — Ming Chow; Sinorica, LLC

(57) ABSTRACT

An electrical connector includes a casing, touch unit, processing module, light source unit, and connection unit. The casing has a receiving portion for receiving the processing module and the light source unit. The touch unit is disposed above the casing and adapted to be touched by a user to thereby generate a triggering signal. The processing module receives the triggering signal and outputs a current. The light source unit and the processing module are connected. The current drives the light source unit, such that the light source unit emits a light beam to be conveyed to the electronic device by the casing and the touch unit. The connection unit is connected to an electronic device for receiving a current and data from the electronic device. The electrical connector enables the electronic device to be illuminated, such that a user can connect the electrical connector to the electronic device easily.

10 Claims, 5 Drawing Sheets

ELECTRICAL CONNECTOR

FIELD OF TECHNOLOGY

The present invention relates to electrical connectors, and more particularly, to an electrical connector that enables an electronic device to be illuminated in an environment of a low light intensity.

BACKGROUND

According to the prior art, a data and/or a current is transmitted between electronic devices by means of a transmission line connected therebetween. Examples of the electronic devices include a mobile power source, a portable mobile communication device, a tablet computer, a charger, a keyboard, and a mouse.

The transmission line comprises a wire and two electrical connectors. The two electrical connectors are each connected to an end of the wire. According to the prior art, the transmission line is made portable by downsizing the wire and the two electrical connectors.

However, the downsized electrical connectors have a drawback—in an environment of a low light intensity, a user finds it difficult to connect the electrical connectors to an electronic device easily and precisely.

Accordingly, it is imperative to provide an electrical connector that solves the aforesaid drawback of the prior art.

SUMMARY

It is an objective of the present invention to provide an electrical connector comprising a touch unit and a light source unit such that the touch unit can be touched to drive a light source unit to generate a light beam adapted to fall on an electronic device eventually. Hence, with the electronic device being illuminated by the light beam, a user can connect the electrical connector to the illuminated electronic device easily and precisely.

Another objective of the present invention is to provide the electrical connector adapted to be connected to an electronic device which receives a triggering signal from the touch unit, such that the electronic device operates in different modes, such as an off mode, a sleep mode, and an on mode, to thereby perform power management.

Yet another objective of the present invention is to provide the electrical connector adapted to be connected to a first electronic device and a second electronic device, such that the user can touch the touch unit to thereby send a current and/or a data from the first electronic device to the second electronic device.

In order to achieve the above and other objectives, the present invention provides an electrical connector for use with a first electronic device and a second electronic device. The electrical connector comprises a casing, a touch unit, a processing module, a light source unit, and a connection unit. The casing has a receiving portion. The casing is made of a transparent material or a translucent material. The touch unit is disposed above the casing and adapted to be touched by a user to thereby generate a triggering signal. The processing module is disposed in the receiving portion. The processing module is connected to the touch unit for receiving the triggering signal from the touch unit, such that the processing module can output a current. The light source unit is disposed in the receiving portion. The light source unit is connected to the processing module for receiving the current from the processing module. The current drives the light source unit to emit a light beam. The light beam is conveyed to the first electronic device and the second electronic device by the casing and the touch unit. The connection unit is disposed in at least a portion of the receiving portion. The connection unit has a first terminal and a second terminal. The first terminal is connected to the first electronic device, and the second terminal is connected to the second electronic device. A current and a data are transmitted between the first terminal and the second terminal. The current and the data originate from the first electronic device or the second electronic device.

Unlike the prior art, the present invention provides an electrical connector that comprises a light source unit and can be easily and precisely connected by a user to an electronic device in an environment of a low light intensity, by illuminating the electronic device with a light beam emitted from the light source unit.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION

Figure 1:
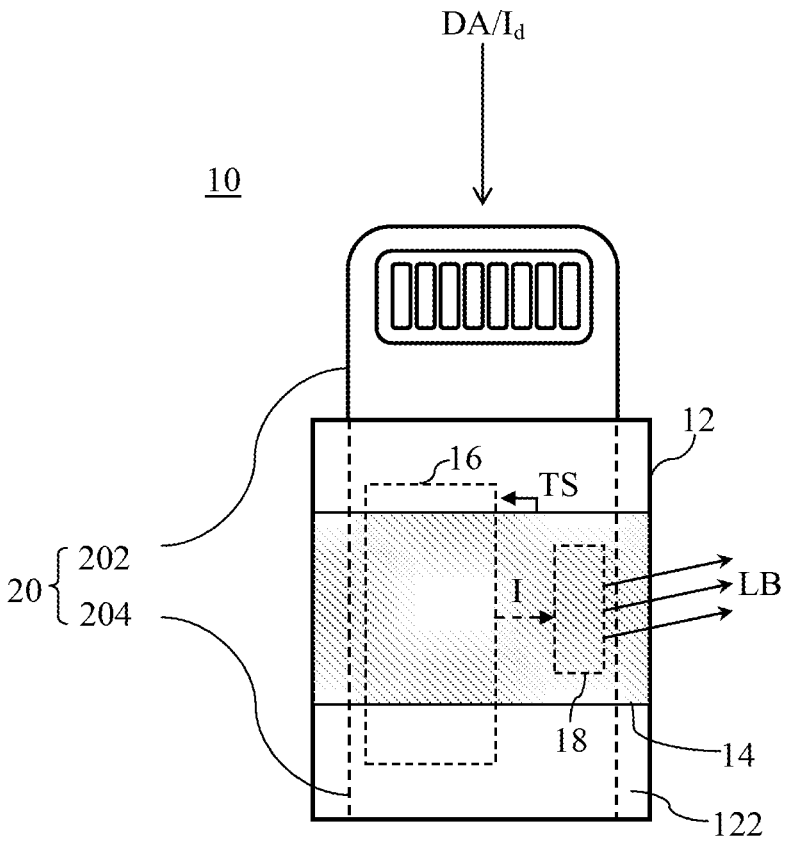
FIG. 1 is a structural schematic view of an electrical connector according to the first embodiment of the present invention.
Figure 2:
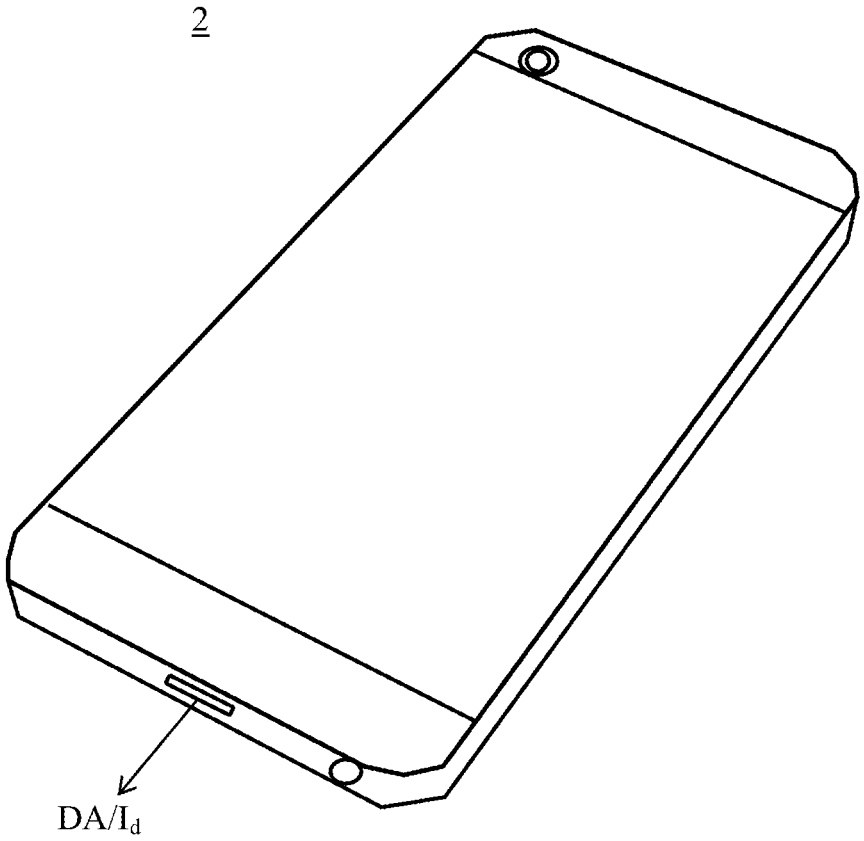
FIG. 2 is a schematic perspective view of an electronic device as shown in FIG. 1 according to the present invention.

Referring to FIG. 1, there is shown a structural schematic view of an electrical connector according to the first embodiment of the present invention. As shown in FIG. 1, the electrical connector 10 is connected to an electronic device 2 shown in FIG. 2. The electronic device 2 can be exemplified by a mobile power source, a portable mobile communication device, a tablet computer, a charger, a keyboard, or a mouse. In this embodiment, the electronic device 2 is exemplified by a portable mobile communication device. The portable mobile communication device outputs a current $I_d$ and a data DA.

Referring to FIG. 1, the electrical connector 10 comprises a casing 12, a touch unit 14, a processing module 16, a light source unit 18, and a connection unit 20.

The casing 12 has a receiving portion 122. The receiving portion 122 receives the processing module 16 and the light source unit 18. The casing 12 is made of a transparent material or a translucent material. For example, the casing 12 is made of a silicon dioxide, a polyethylene, a polypropylene, a polyvinyl chloride, a polycarbonate, a polymethacrylate, and/or a polyethylene terephthalate. In this embodiment, the casing 12 is exemplified by a transparent material.

The touch unit 14 is disposed above the casing 12. The touch unit 14 comprises a transparent conductive thin-film and/or an inductive conductive wire. For example, the transparent conductive thin-film is made of indium tin oxide. For example, as soon as a user touches the touch unit 14, a capacitive or resistive change happens to the transparent conductive thin-film to thereby enable the touch unit 14 to send a triggering signal TS.

The processing module 16 is connected to the touch unit 14 to receive the triggering signal TS from the touch unit 14. The triggering signal TS triggers the processing module 16, such that the processing module 16 outputs a current I.

The light source unit 18 is connected to the processing module 16 to receive the current I from the processing module 16. The current I drives the light source unit 18 to generate the light beam LB. Since both the casing 12 and the touch unit 14 are made of a transparent material, the light beam LB passes through the casing 12 and the touch unit 14 and then falls on the electronic device 2.

The connection unit 20 comprises a first terminal 202 and a second terminal 204.

The first terminal 202 protrudes from the receiving portion 122. The second terminal 204 is disposed in the receiving portion 122. The first terminal 202 is connected to the electronic device 2 to thereby receive the data DA and the current $I_d$ from the electronic device 2. Since the first terminal 202 and the second terminal 204 are connected, the data DA and the current $I_d$ are transmitted to the second terminal 204 via the first terminal 202. The first terminal 202 and the second terminal 204 each comply with the communication protocol of one of an IEEE 1394, a universal serial bus (USB), a micro USB, a mini USB, an Apple 30-pin dock, and an Apple lightning.

Figure 3:
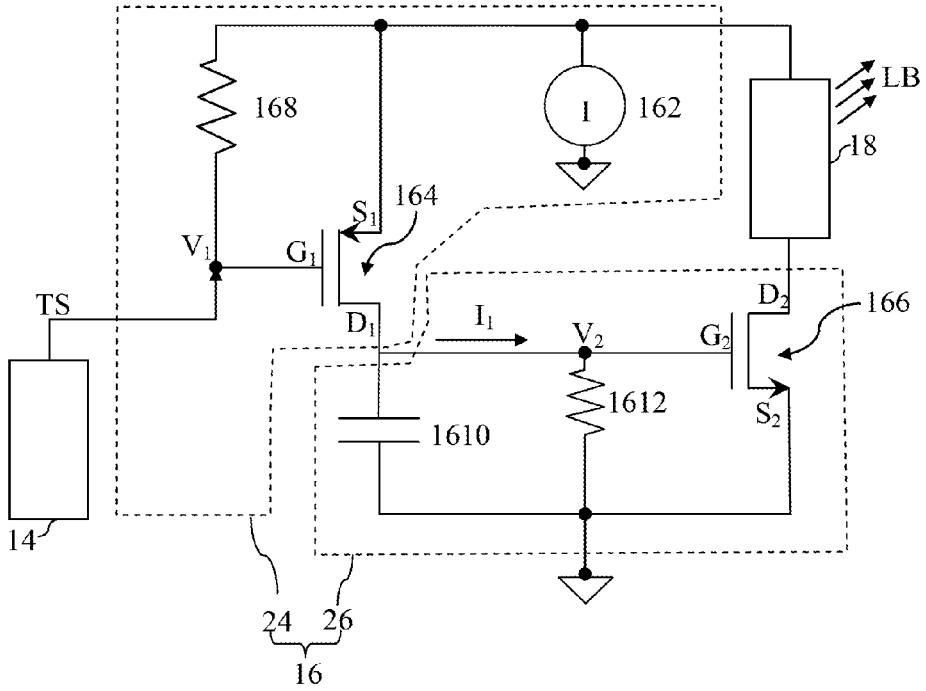
FIG. 3 is a schematic view of a circuit connecting a touch unit, a processing module, and a light source unit as shown in FIG. 1 according to the present invention.

Referring to FIG. 3, there is shown a schematic view of a circuit connecting a touch unit, a processing module 16, and a light source unit as shown in FIG. 1 according to the present invention. As shown in FIG. 3, the processing module 16 comprises a voltage unit 162, a first switch unit 164, a second switch unit 166, a first resistor 168, a capacitor 1610, and a second resistor 1612.

There is a voltage V across the voltage unit 162. For example, the voltage unit 162 is a secondary battery and/or a capacitor.

The first switch unit 164 and the second switch unit 166 are each a semiconductor component. The semiconductor component has a first terminal, a second terminal, and a third terminal. For example, the semiconductor component is a metal oxide semiconductor field effect transistor (MOSFET). The MOSFET comprises a gate, a drain and a source. The gate is defined as the first terminal, the drain is defined as the second terminal, and the source is defined as the third terminal.

The MOSFET works in the following manner: applying a voltage (hereinafter referred to as "gate voltage") to the gate to thereby allow a plurality of electrons and/or a plurality of holes to be attracted to between the drain and the source. The drain and the source are electrically connected by means of the electrons and/or the holes. The aforesaid electrical connection is hereunder referred to the electrically conductive state between the drain and the source.

To attract enough electrons and/or holes, the gate voltage has to be higher than a critical voltage. For example, the critical voltage ranges between 1V and 3V. Hence, in the situation where the gate voltage is not applied to the gate or in the situation where the applied gate voltage is lower than the critical voltage, no sufficient amount of electrons and/or holes is attracted to between the drain and the source; hence, there is no electrical connection therebetween, thereby allowing a disconnected state to be formed between the drain and the source.

In this embodiment, the first switch unit 164 is exemplified by a p-channel enhanced MOSFET, and the second switch unit 166 is exemplified by an n-channel enhanced MOSFET.

The first switch unit 164 has a first gate $G_1$, a first drain $D_1$, and a first source $S_1$. The second switch unit 166 has a second gate $G_2$, a second drain $D_2$, and a second source $S_2$.

The processing module 16 comprises a first circuit 24 and a second circuit 26.

The first circuit 24 comprises the voltage unit 162, the first switch unit 164, and the first resistor 168. The voltage unit 162 applies a first voltage $V_1$ to a first gate $G_1$ through the first resistor 168. The first voltage $V_1$ is lower than the critical voltage of the first gate $G_1$.

Given the triggering signal TS (which has a voltage level) from the touch unit 14, the first voltage $V_1$ can boost the total voltage at the first gate $G_1$, such that the total voltage exceeds the critical voltage. Hence, the triggering signal TS triggers the formation of an electrically conductive state between the first drain $D_1$ and the first source $S_1$. By contrast, a disconnected state between the first drain $D_1$ and the first source $S_1$ will form, if the first voltage $V_1$ is applied to the first gate $G_1$ in the absence of the triggering signal TS.

The second circuit 26 comprises the second switch unit 166, the capacitor 1610, and the second resistor 1612. As mentioned above, once the electrically conductive state between the first drain $D_1$ and the first source $S_1$ is formed, the voltage V from the voltage unit 162 will further be applied to the second circuit 26 via the first drain $D_1$ and the first source $S_1$, whereas a first current $I_1$ is measurable at the second circuit 26. The first current $I_1$ passes through the second resistor 1612, such that there is a second voltage $V_2$ across the two ends of the second resistor 1612. In this embodiment, with the second resistor 1612 being of an appropriate resistance value, the second voltage $V_2$ applied to the second gate $G_2$ exceeds the critical voltage of the second gate $G_2$. Hence, an electrically conductive state between the second drain $D_2$ and the second source $S_2$ is formed.

In this embodiment, the light source unit 18 is connected to the voltage unit 162 and the second drain $D_2$. As mentioned above, once the electrically conductive state between the second drain $D_2$ and the second source $S_2$ is formed, the voltage V from the voltage unit 162 will further be applied to the light source unit 18 to thereby emit the light beam LB. By contrast, if a disconnected state between the second drain $D_2$ and the second source $S_2$ is formed, the voltage V from the voltage unit 162 cannot be applied to the light source unit 18.

Hence, the triggering signal TS can change the electrically conductive state of the first switch unit 164 and the electrically conductive state of the second switch unit 166 to thereby enable the light source unit 18 to emit the light beam LB.

Figure 4:
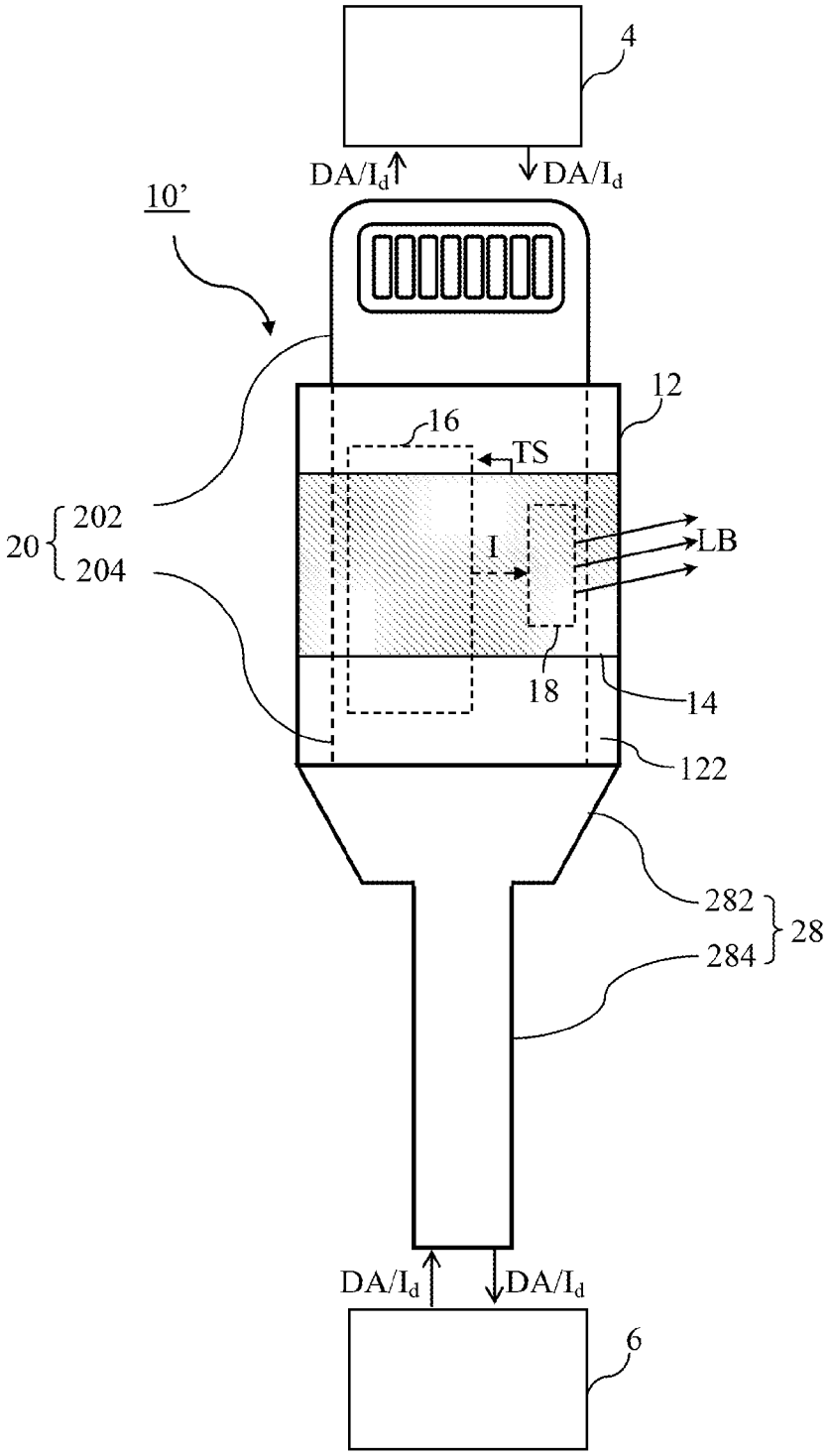
FIG. 4 is a structural schematic view of an electrical connector according to the second embodiment of the present invention.

Referring to FIG. 4, there is shown a structural schematic view of an electrical connector 10' according to the second embodiment of the present invention. As shown in FIG. 4, the electrical connector 10' connects a first electronic device 4 and a second electronic device 6, such that the current $I_d$ and the data DA are transmitted between the first electronic device 4 and the second electronic device 6.

The electrical connector 10' comprises a casing 12, a receiving portion 122, a touch unit 14, a processing module 16, a light source unit 18, a connection unit 20, a first terminal 202 and a second terminal 204, and a cable 28. Except the first terminal 202, the second terminal 204, and the cable 28, the above-mentioned has been describe above in the description of the first embodiment and thus is not described hereunder for the sake of brevity.

The first terminal 202 is connected to the first electronic device 4.

The cable 28 has a first end 282 and a second end 284. The first end 282 is connected to the second terminal 204. The second end 284 is connected to the second electronic device 6.

Figure 5:
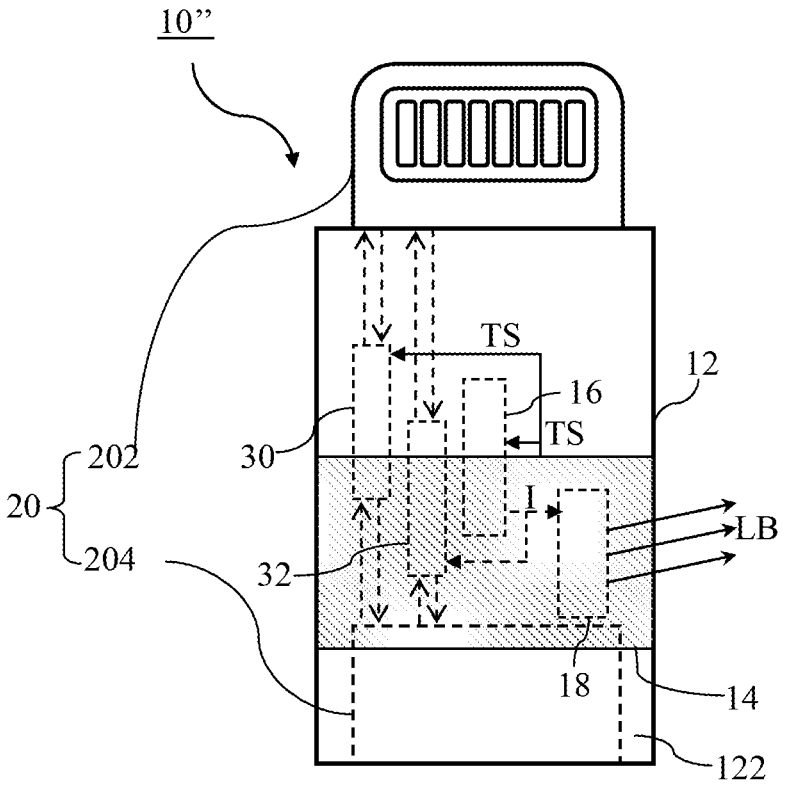
FIG. 5 is a structural schematic view of an electrical connector according to the third embodiment of the present invention.

Referring to FIG. 5, there is shown a structural schematic view of an electrical connector 10" according to the third embodiment of the present invention. As shown in FIG. 5, the electrical connector 10" comprises a casing 12, a receiving portion 122, a touch unit 14, a processing module 16, a light source unit 18, a connection unit 20, a first terminal 202, a second terminal 204, a first control unit 30, and a second control unit 32. Except the first control unit 30 and the second control unit 32, the above-mentioned is described above in the description of the first embodiment and thus is not described hereunder for the sake of brevity.

The first control unit 30 is connected to the first terminal 202, the second terminal 204, and the touch unit 14. The touch unit 14 generates and sends the triggering signal TS to the first control unit 30, such that the first terminal 202 is connected to the second terminal 204. Conversely, if the touch unit 14 does not generate the triggering signal TS, the first terminal 202 cannot be connected to the second terminal 204.

The second control unit 32 is connected to the first terminal 202, the second terminal 204, and the processing module 16. The processing module 16 outputs a current I to the second control unit 32, such that the first terminal 202 is connected to the second terminal 204. By contrast, if the second control unit 32 does not receive the current I from the processing module 16, the first terminal 202 cannot be connected to the second terminal 204.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. An electrical connector for use with a first electronic device and a second electronic device, the electrical connector comprising:

a casing having a receiving portion and made of one of a transparent material and a translucent material;

a touch unit disposed above the casing and adapted to be touched by a user to thereby generate a triggering signal;

a processing module disposed in the receiving portion, connected to the touch unit, and adapted to receive the triggering signal from the touch unit to enable the processing module to output a current;

a light source unit disposed in the receiving portion, connected to the processing module, and adapted to receive the current from the processing module, wherein the current drives the light source unit to emit a light beam conveyed to the first electronic device and the second electronic device by means of the casing and the touch unit; and a connection unit disposed in at least a portion of the receiving portion and having a first terminal and a second terminal, the first terminal being connected to the first electronic device, and the second terminal being connected to the second electronic device, wherein a current and a data which originate from the first electronic device or the second electronic device are transmitted between the first terminal and the second terminal.

2. The electrical connector of claim 1, wherein the casing is made of a silicon dioxide, a polyethylene, a polypropylene, a polyvinyl chloride, a polycarbonate, a polymethacrylate, and/or a polyethylene terephthalate.

3. The electrical connector of claim 1, wherein the touch unit is at least one of a transparent conductive thin-film and an inductive conductive wire.

4. The electrical connector of claim 1, wherein the processing module comprises a voltage unit having the voltage.

5. The electrical connector of claim 4, wherein the voltage unit is at least one of a secondary battery and a capacitor.

6. The electrical connector of claim 4, wherein the processing module comprises switch units each of which is a semiconductor component having a first terminal, a second terminal, and a third terminal, the first terminal being connected to the touch unit, the second terminal being connected to the light source unit, and the third terminal being connected to the voltage unit, wherein the touch unit sends the triggering signal to the first terminal such that an electrically conductive state between the second terminal and the third terminal is formed.

7. The electrical connector of claim 6, wherein the semiconductor component is a metal oxide semiconductor field effect transistor (MOSFET) comprising a gate, a drain, and a source, the gate being the first terminal, the drain being the second terminal, and the source being the third terminal.

8. The electrical connector of claim 1, wherein the connection unit comprises a first control unit connected to the first terminal, the second terminal, and the touch unit, such that the touch unit sends the triggering signal to the first control unit to thereby enable the first terminal to be connected to the second terminal.

9. The electrical connector of claim 1, wherein the connection unit comprises a second control unit connected to the first terminal, the second terminal, and the processing module, such that the processing module outputs the current to the second control unit to thereby enable the first terminal to be connected to the second terminal.

10. The electrical connector of claim 1, further comprising a cable having an end connected to the second terminal.

* * * * *